US005816737A

United States Patent [19]

Siblik

[11] Patent Number: 5,816,737

[45] Date of Patent: Oct. 6, 1998

[54] SIGNAL ASSEMBLY FOR ROADWAY MARKERS

[75] Inventor: Allen D. Siblik, Wadsworth, Ill.

[73] Assignee: Hallen Products Ltd., Wadsworth, Ill.

[21] Appl. No.: 725,979

[22] Filed: Oct. 4, 1996

[51] Int. Cl.[6] ..... E01F 9/06

[52] U.S. Cl. ..... 404/13; 404/14; 404/16

[58] Field of Search ..... 116/63 R, 63 P; 404/13, 14, 15, 16, 12

[56] References Cited

U.S. PATENT DOCUMENTS

| | | | |
|---|---|---|---|
| 1,952,471 | 3/1934 | Stern et al. | 404/15 |
| 3,392,639 | 7/1968 | Heenan et al. | 116/63 R |
| 3,627,403 | 12/1971 | Hedgewick | 404/14 X |
| 3,758,191 | 9/1973 | Hedgewick | 116/63 R X |
| 3,784,279 | 1/1974 | Hedgewick | 404/12 X |
| 4,129,397 | 12/1978 | Eigenmann | 404/14 |
| 4,340,319 | 7/1982 | Johnson, Jr. et al. | 404/16 |
| 4,428,320 | 1/1984 | Oplt et al. | 404/14 X |
| 4,875,798 | 10/1989 | May | 404/14 X |
| 5,002,424 | 3/1991 | Hedgewick | 404/16 X |
| 5,308,186 | 5/1994 | Hedgewick | 404/16 X |
| 5,340,231 | 8/1994 | Steere et al. | 404/14 |
| 5,354,143 | 10/1994 | Lindner | 404/14 X |
| 5,393,166 | 2/1995 | Stock et al. | 404/14 |
| 5,403,115 | 4/1995 | Flader | 404/12 X |
| 5,454,664 | 10/1995 | Siblik | 404/14 |
| 5,667,335 | 9/1997 | Khieu et al. | 404/12 X |

FOREIGN PATENT DOCUMENTS

| | | | |
|---|---|---|---|
| 1 215 362 | 12/1970 | United Kingdom | 404/16 |

*Primary Examiner*—James Lisehora
*Attorney, Agent, or Firm*—McCaleb, Lucas & Brugman

[57] ABSTRACT

An improved, unitary signal assembly operable to replace removeable signal assemblies of sub-surface mounted roadway markers or alternatively capable of being mounted directly to pavement surfaces comprising a load carrying, rigid, compression resistant, metal center bar for transmitting vertical loads directly to a rigid base mounted in a sub-surface depression formed in a paved roadway or directly to the roadway surface when mounted independently of such a base; the center bar being integrated with a support base carrying at least one light emitting signal device formed separate or integrally with angularly disposed sides of the base; the center bar including a laterally extending canopy at its upper end operable for protectively overhanging the upper end of a signal device to insulate the same from impact loads.

16 Claims, 3 Drawing Sheets

SIGNAL ASSEMBLY FOR ROADWAY MARKERS

This invention is directed to roadway pavement markers used to delineate highway traffic lanes and more particularly to improved, low-profile, load resistant, markers having light emitting signal assemblies.

BACKGROUND OF THE INVENTION

Markers for delineating highway traffic lanes by means of a series of spaced light emitting signals are familiar to motorists throughout the United States. Typically, such markers are designed to generate warning signals to the motorist by reflecting light from the head lights of approaching automotive vehicles.

In areas where relatively heavy to moderate snow is experienced during the winter months, snowplowable highway markers incorporating reflective light signal assemblies are popularly used. However, these markers are subject to heavy wear and tear from impact with traffic and snow plow blades. Frequently, the markers are dislodged from the pavement/or the signal assemblies thereof seriously damages. U.S. Pat. No. 4,147,447 of Apr. 3, 1979, typifies one such known marker structure.

More recently U.S. Pat. No. 5,454,664, issued Oct. 3, 1995, to the Assignee hereof sets forth an improved low profile snowplowable pavement marker having a cast metal base mountable in a shallow recess in the highway pavement to present a pair of below the road surface vision ramps separated by a rigid vertical wall integral with the base. Light reflective signal means are mounted on opposite sides of the wall with their upper ends protected by an overhanging canopy which shields the same from damage by vehicle tire and snow plow blade impact.

SUMMARY OF THE INVENTION

The present invention is directed to an improved, unitary signal assembly capable of replacing currently known replaceable signal assemblies associated with sub-surface anchored roadway markers or alternatively mounted independently on pavement surfaces.

The signal assembly hereof comprises a rigid, compression resistant member having a vertically oriented center bar distinguished by one or more planar mounting pads at the lower end of the center bar for transmitting impact loads directly to an underlying support.

In a preferred embodiment, a glass or plastic support base of trapezoidal cross section is formed in situ with the center bar to provide a unitary assembly having a planar bottom mounting surface incorporating the mounting pads. Suitable elongated recesses formed in the outside sloping side walls of the support base receive one or more plastic or glass, metalized or air gap, light emitting lens reflectors that are fixed in place with the upper ends thereof located protectively beneath an overhanging canopy of the center bar. Alternatively, the support base may be formed as an external hollow shell having the interior faces of sloping side walls thereof formed with outside lens receptive recesses or interior metalized light reflective lens facets; the center bar being assembled with the shell and potted in place to provide an integrated unitary assembly. If the base is formed with exterior recesses receptive of reflecting lenses the latter are welded or glued in place. In operation suitable mastic is employed to secure the signal assembly hereof to a sub-surface mounted roadway marker or directly to the pavement surface.

It is a primary object of this invention to provide a new and improved unitary light emitting signal assembly for roadway markers.

It is a further important object of this invention to provide a unitary light emitting signal assembly which is useful in roadway markers employing replaceable signal assemblies.

Another important object of this invention is to provide a unitary light emitting signal assembly operable as a surface-mounted roadway marker.

Still another object of this invention is to provide a unitary light emitting signal assembly for roadway markers that embodies a central load bearing member for resisting traffic and snow plow impact forces while protecting associated light emitting signals from such forces.

A still further object of this invention is to provide an improved signal assembly for road markers which promotes longer use life by protecting the light emitting components thereof from traffic and snow plow blade impact.

A still further object of this invention is to provide an improved, versatile, low profile, light emitting, highway marker signal assembly embodying glass or plastic, detachable or integral, air gap or metalized, reflective lenses of selected color.

Having thus described this invention the above and further objects, features and advantages thereof will be recognized from the following detailed description of a preferred embodiment thereof, illustrated in the accompanying drawings and representing the best mode currently contemplated for enabling those skilled in the art to practice this invention.

DESCRIPTION OF THE PREFERRED EMBODIMENT

Figure 1:
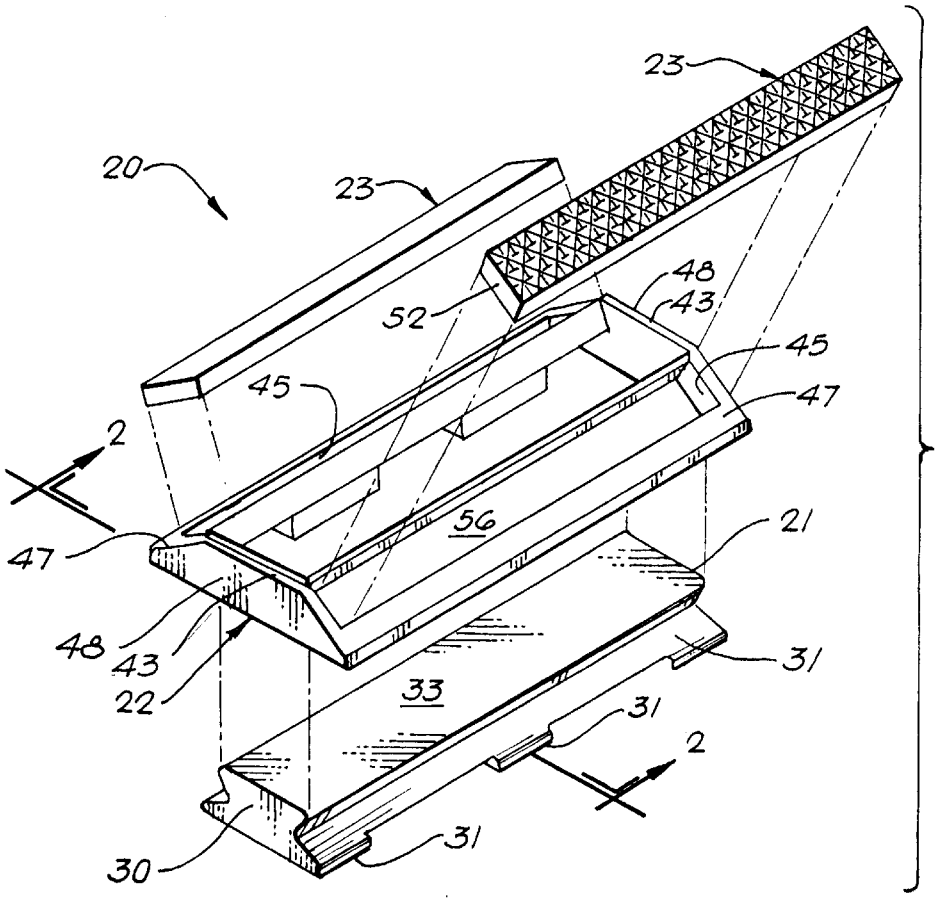
FIG. 1 is an exploded perspective view illustrating the several components of a preferred signal assembly according to this invention.

Turning initially to FIG. 1 of the drawings it will be recognized that the signal assembly, indicated generally at 20 therein, comprises four primary components, namely, a rigid load carrying center bar 21 and, a supporting base 22 receptive of bar 21, a pair of light emitting assemblies 23 or alternatively a single reflective assembly 23 and a non-reflective blank 50.

Figure 2:
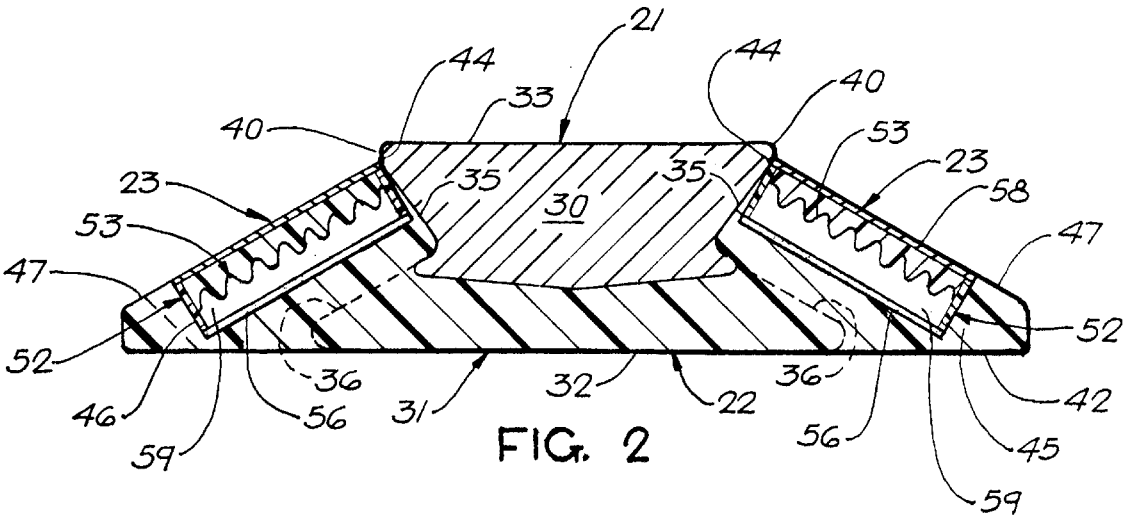
FIG. 2 is an enlarged cross sectional view of the assembled components seen in FIG. 1, viewed substantially from vantage line 2—2 of FIG. 1 and looking in the direction of the arrows thereon.
Figure 3:
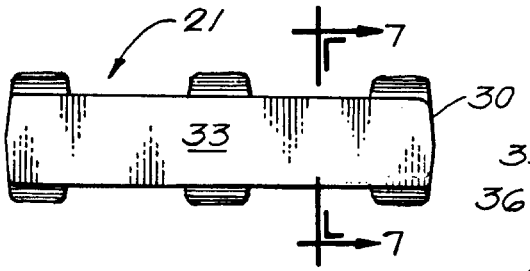
FIG. 3 is a top plan view of the center bar component shown in FIGS. 1 and 2.
Figure 7:
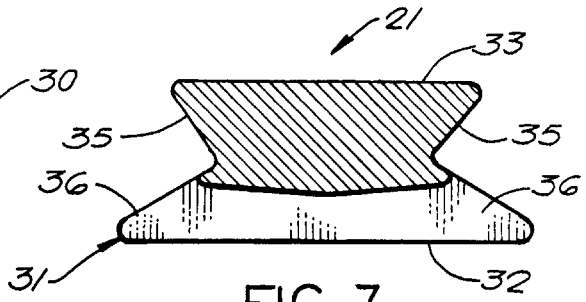
FIG. 7 is an enlarged cross sectional view taken substantially along vantage line 7—7 of FIG. 3, looking in the direction of the arrows thereon.
Figure 4:
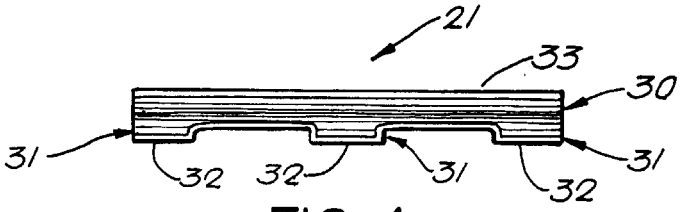
FIG. 4 is a front elevational view thereof.
Figure 5:
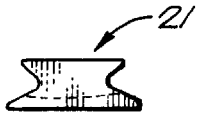
FIG. 5 is an end elevational view thereof.

In FIG. 2, the assembled relationship of the several components set out in FIG. 1 is illustrated. Center bar 21 preferably is cast or machined from iron, steel, light metal alloys or similar rigid, compression resistant materials, which may be hardened if desired to promote longer life and wear resistance. Center bar 21 is a load bearing element which transfers forces directly to a support surface on which the assembly is mounted.

Figure 6:
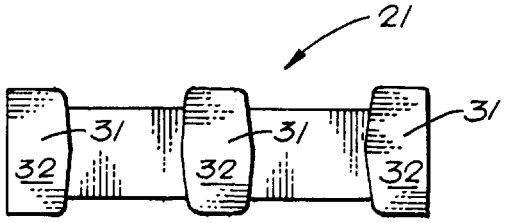
FIG. 6 is a bottom plan view thereof.
Figure 8:
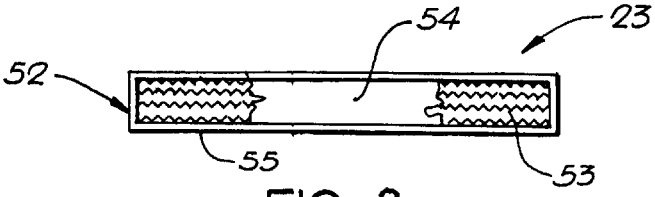
FIG. 8 is a top plan view with portions broken away of an air-gap light reflective lens of the signal assembly shown in FIG. 1.
Figure 9:
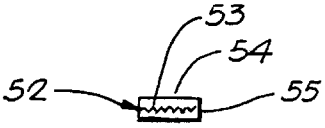
FIG. 9 is an end elevation of the lens shown in FIG. 8.

As shown in FIGS. 1–7 bar 21 comprises an integral unitary elongated body 30 of general trapezoidal cross section having a plurality of integral axially spaced mounting pads 31, 31 extending transversely from the underside of body 30 (see FIG. 6). It will be noted that the cross sectional configuration of each pad 31 may be generally trapezoidal with a planar bottom face wall 32 parallel to the planar top wall 33 of body 30.

To promote stability and bearing surface to the center bar the bottom face walls 32 of the several pads 31 are co-planar and of a lateral extent preferably at least equal to or greater than the width of top wall 33.

As shown, preferably legs 35, 35 of the trapezoidal body 30, converge downwardly from top surface 33 to meet the upper margins of legs 36, 36 associated with mounting pads 31. The intersection of legs 35, 35 and the top wall 33 of the body form canopy portions 40, 40 extending along the upper lateral margins of the body 30 (see FIG. 2).

As previously noted, center bar 21 is held in its operating position by support base 22 also having a trapezoidal transverse cross section. In the preferred embodiment illustrated in FIGS. 1 and 2, support base 22 is unified with the center bar by molding the base intimately about bar 21. This is accomplished by pouring molten or liquid plastic such as ABS or equivalent material into an appropriate mold in which the center bar is held in the mold while the plastic is poured and cast thereabout. Thus the center bar is integrally unified with the hardened plastic so that bottom face walls 32 of pads 31 are co-planar with the bottom face wall 42 of base 22 (see FIG. 2). The canopy portions 40, 40 of the center bar 43 overhang and extend beyond the top end of the cast base 22 where it merges with legs 35 of the center bar body as indicated at 44. The resulting unified integral structure is self supporting and stable with the capability of withstanding substantial vertical impact loads by virtue of the sturdy center bar which transfers loads and forces directly to the underlying support on which the assembly hereof is mounted.

Figure 10:
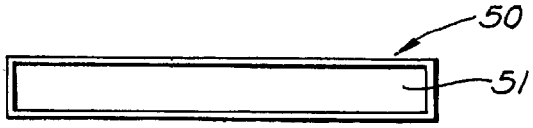
FIG. 10 is a top plan view of a non-reflective blank lens insert.
Figure 11:
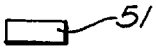
FIG. 11 is an end elevation of the blank insert shown in FIG. 10.
Figure 12:
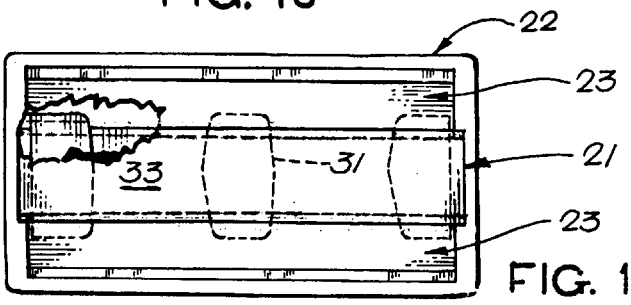
FIG. 12 is a top plan view of the assembled signal assembly hereof.

In addition to integrally embracing the center bar, support base 22 presents a pair of elongated, rectangular sockets 45, 45 in the exteriors of oppositely facing sloping side walls 47, 47 extending lengthwise between trapezoidal end walls 48, thereof. The two sockets 45 are relatively shallow and designed to closely receive light emitting assemblies 23, 23 as shown in FIG. 2. However, as noted heretofore, when the signal assembly of this invention is used for uni-directional road markers, one of the assemblies 23, may be replaced with a blank non-reflective member 50 as shown in FIGS. 10 and 11. As there shown, an opaque plastic non-reflective rectangular body 51 is configured to fit closely within either one of the sockets 45 for uni-directional road marker use.

As particularly shown in FIGS. 1, 2, 8, 9 and 10 the reflector assembly shown preferably employs an air gap type lens formed with a unified molded rectangular plastic or glass lens body 52 having a plurality of integral light reflective facets 53 depending from the backside of a planar rectangular exterior face panel 54 bordered along its four sides by an integral skirt wall 55. Such skirt wall is normal to the plane of face panel 54 and extends beyond the depending light reflective facets 53. Since there is no need for a back panel on the lens body corresponding to the front face panel, facets 53 are openly opposite the bottom wall 56 of its associated socket 45 (see FIGS. 1 and 2). Once the lens is installed in its socket 45, it is integrated with base 22 and sealed in place as by ultrasonic welding, epoxy 58 or the equivalent thereto to provide a sealed air chamber 59 between the facets 53 and socket wall 56. Such air gap lens reflectors are preferred because of their efficient reflectivity.

As previously mentioned, the lens members also may be glass, in which event clear air hardened or tempered glass is preferred for improved wearability.

As best seen in FIG. 2, the installed lens members 52 are protected along their upper edges by the overhang of the canopy portions 40.

In substitution of the preferred air gap lens members, the facets 53 thereof may be metalized to form a mirror backing to provide good light reflectivity to headlights of an oncoming vehicle or sunlight during daylight hours. If this form of lens is used, it is not necessary to provide a sealed air chamber between the lens body 51 and bottom wall 56 of the sockets 45.

The foregoing described preferred embodiment of this invention is particularly adapted for use as a replaceable assembly in a below road surface mounted metal base casting. Optionally it also may be secured directly to the pavement surface independently of any road anchored base in climates where snowplows or other snow removal equipment is not used. In both types of installation, the assembly hereof may be held in operating position by appropriate mastic such as epoxy or a butyl pad extending over the bottom face of the integrated center bar pads and the support base in accordance with known mounting practice.

Figure 13:
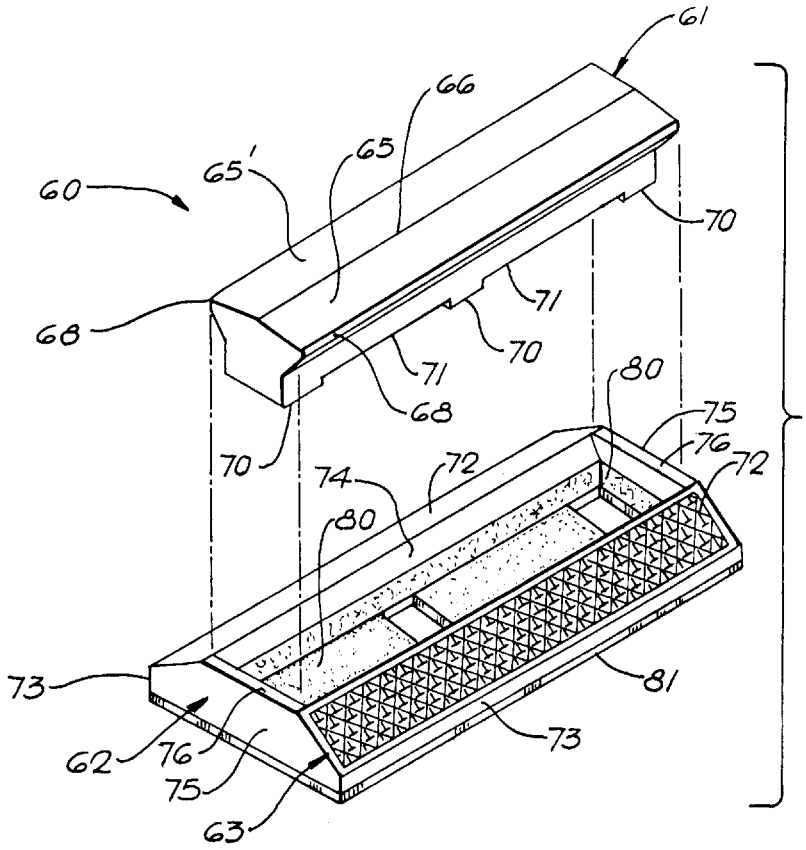
FIG. 13 is an exploded perspective view of a modified signal assembly according to this invention.
Figure 14:
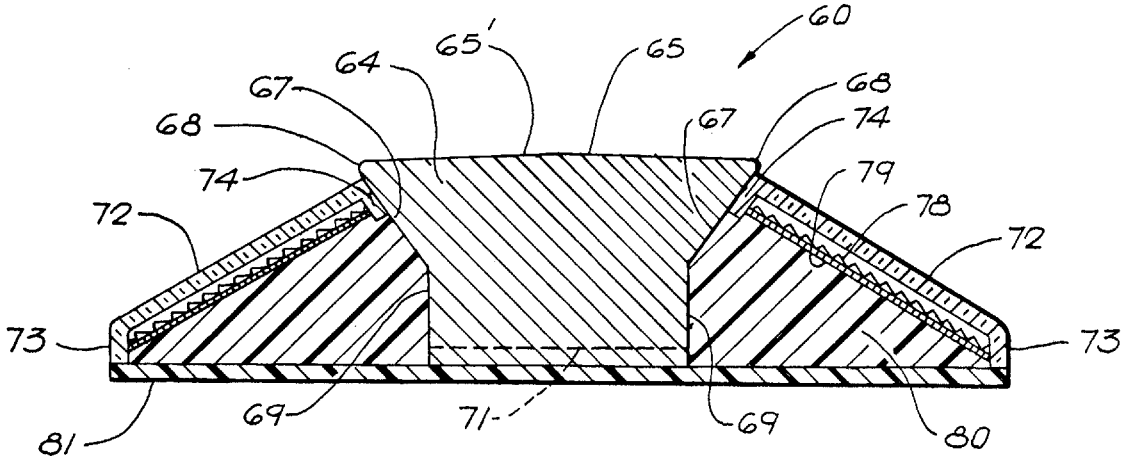
FIG. 14 is an enlarged cross sectional view similar to FIG. 2, taken transversely of integrated components of the light assembly shown in FIG. 13.

In FIGS. 13–14 a modified version of the above described preferred embodiment is illustrated.

As shown, the modified signal assembly 60, comprises a unitary metal center bar 61, a support base 62 and a pair of light emitting signal assemblies 63 corresponding to components 21–23 described above.

In the particular modified version shown, the center bar 61 is formed with an elongated cast metal body having a generally trapezoidal cross sectioned upper end portion 64, defined by a pair of angularly intersecting top wall portions 65 and 65' forming a slight centrally extending ridge 66 therealong. If desired the ridge may be eliminated by making surfaces 65 and 65' co-planar or merged along an arc. Angularly disposed upwardly divergent side walls or legs 67, 67 of the trapezoidal configuration intersect the top wall surface to form laterally extending canopy portions 68, 68. Unlike the center bar 21, previously described, the integral lower portion of center bar 61 is of rectangular cross section defined by operationally vertical side walls 69, 69 having axially spaced pedestal pads 70, 70 projecting from a planar bottom wall 71 thereof (see FIG. 13). This permits the center bar to be mounted easily in the support base 62 as will be explained more fully presently.

The support base 62, unlike the solid cast base 22 of the previously described form of this invention is formed of molded plastic or hard glass as an open bottom shell having angularly sloping relatively thin side walls 72, 72 which merge with short rectangular vertical walls 73, 73 at their lower margins and angularly intersecting wall portions 74, 74 extending along their upper margins. Trapezoidal shaped end walls 75, extend integrally between the walls 72, 73 and 74 to enclose the shell ends and define the top 76 of base 62 (see FIG. 13).

Each of the side walls 72 may be molded with a rectangular lens receptive socket (not shown), as in the molded support base 21 of the FIGS. 1–12 embodiment described above, for retaining either air gap or metalized facet lens members, as previously described. As illustrated, walls 72 alternatively also may be formed with signal assemblies 63 having integrally molded light reflective metalized facets 78 on the inner faces of walls 72. In this respect if a unidirectional pavement marker is desired, only one wall 72 will be so formed. In the illustrated embodiment reflective facets 78 are opposed or coated by metalized coating 79 as shown in FIG. 14 and walls 72 are transparent.

As a further alternative, instead of casting facets or rectangular lens receptive sockets in walls 72, such may be formed with corresponding openings receptive of selected types of lens members, which are then mounted in the socket openings for unification with the shell of the support base as will be described hereafter.

As shown best in FIG. 14, the center bar, support base and lens components are unified by potting material such as sand filled epoxy indicated at 80, which fills the void or hollow interior of the shell base 62 and intimately embraces the portions of the center bar 61 and the light emitting assemblies 63 extending into the interior of shell 62. The potting operation is accomplished by dropping the center bar into the opening between the elongated angularly disposed wall portions 74 of the shell base defining the upper lateral margins of the side walls 72. It will be noted that the angular divergence of the legs 67 on the center bar matches the angular disposition of wall portions 74 to provide a tight wedge fit therebetween.

If walls 72 are formed with elongated lens receptive openings, as above noted, the signal assemblies 63 are inserted into such openings. If walls 72 have metalized integral facets 78 on their inner faces there is no need to so mount the light assemblies in the shell.

In either event the shell, center bar and light assemblies, integral or separate are inverted from their normal operating positions of FIGS. 13 and 14, and the open bottom of the shell then filled with potting material 80. By so doing the pedestal pads 71 and all surfaces of the shell, center bar, as well as portions of the light emitting assemblies accessible from the interior of the base shell are intimately adhered with the potting material and integrated into a unitary signal assembly according to this invention. When the potting material is set, a butyl pad or its equivalent, indicated at 81, is mounted over the exposed potting and shell walls, to provide means for attaching assembly 60 to a separate sub-surface mounted pavement marker base, or directly to the pavement surface, as discussed heretofore.

From the foregoing, it is believed that those familiar with the art will readily recognize and appreciate the novel advancement of this invention over the prior art and will understand that while this invention has been described in relation to the particular preferred and modified embodiments thereof illustrated in the drawings, such is susceptible to changes, modifications and substitutions of equivalents without departing from the spirit and scope of the invention which is intended to be unlimited by the foregoing except as may appear in the following appended claims.

The embodiments of the invention in which an exclusive property or privilege is claimed are defined as follows:

1. A unitary roadway marker signal assembly constructed for detachable connection to a separate underlying support, comprising:

a rigid compression resistant member incorporating an elongated, vertically oriented center bar;

symmetrical canopy portions projecting integrally outward from an elongated upper end of said center bar;

a support base closely embracing said center bar and comprising a bottom, two converging side walls, two end walls and a top that is overhung by said canopy portions;

light reflective lens means mounted on at least one of said side walls;

said canopy portions overhanging and protecting said lens means from impact loads and said rigid member transmitting vertical impact loads directly to a separate underlying support.

2. The assembly of claim 1, wherein said rigid member is metal and said support base is molded in situ about said member.

3. The assembly of claim 1, wherein said center bar is cast iron, and said support base is ABS plastic molded intimately about said bar.

4. The assembly of claim 1, and pad means comprising integral lateral extensions of a lower end of said center bar for stabilizing said bar in a vertical mounted position; said pad means being adhesively secured to said underlying support.

5. The assembly of claim 1, wherein said rigid member is cast metal and said support base is glass molded about said member to intimately embrace and support said member.

6. The assembly of claim 1, wherein said base comprises upwardly convergent planar side walls, each formed with a lens receptive socket.

7. The assembly of claim 1, wherein said support base is a molded shell housing said center bar, and potting material interbonding said shell and said center bar.

8. The assembly of claim 1, wherein said base is trapezoidal in transverse cross section comprising convergent legs forming said side walls, and said light reflective lens means comprises light reflective facets molded integrally with interior faces of said side walls.

9. The assembly of claim 1, wherein said lens means comprise unitary air gap lenses, each of said side walls having a lens receptive socket, and means sealing an air gap lens in each socket.

10. A unitary replaceable signal assembly for use in a roadway marker employing a heavy metal casting anchored in a depression formed in a roadway, comprising:

a three-dimensional rectangular support base of trapezoidal cross section made of a first material forming an elongated central opening extending between a top wall and a planar bottom wall thereof; and a metal center bar of a second material substantially more rigid and compression resistant than said first material, intimately embraced within said central opening and having non-vertical side walls, said bar extending between said top wall and said bottom wall and having a planar face substantially co-planar with said bottom wall to transfer forces applied to an upper end of said bar directly to an underlying metal casting on which said assembly is removeably mounted; and at least one light emitting signal device mounted on an inclined side wall of said support base.

11. The assembly of claim 10, wherein an upper end of said center bar overhangs said top wall of said support base to form a protective canopy over said signal device.

12. The assembly of claim 10, wherein said support base is molded in situ about said center bar.

13. The assembly of claim 10, wherein a bottom end of said center bar includes a plurality of transverse feet having recesses therebetween filled by said support base.

14. The assembly of claim 10, wherein said top wall and said bottom wall of said center bar are of equal length and unequal width.

15. A unitary detachable signal assembly for use in a snowplowable roadway marker comprising:

a three-dimensional, rectangular, support base of a first material;

said base having a trapezoidal cross section defined by end, top and bottom surfaces intersected by a pair of angularly disposed, opposing side walls;

a center bar of a second material substantially more rigid and compression resistant than said first material, extending between said top and bottom surfaces of said support base to transfer forces applied to said bar directly to a separate underlying surface on which the assembly is detachably mounted.

16. The assembly of claim 15, wherein said center bar has non-vertical convergings side walls, and elongated canopy portions extending laterally outward over upper ends of said sidewalls.

* * * * *